US006612725B2

(12) United States Patent
Camarota et al.

(10) Patent No.: US 6,612,725 B2
(45) Date of Patent: Sep. 2, 2003

(54) LAMP ASSEMBLY WITH SELECTIVELY POSITIONABLE BULB

(75) Inventors: Richard Camarota, Holland, MI (US); Richard Hartmann, Jr., Holland, MI (US)

(73) Assignee: ITC Incorporated, Holland, MI (US)

( * ) Notice: Subject to any disclaimer, the term of this patent is extended or adjusted under 35 U.S.C. 154(b) by 159 days.

(21) Appl. No.: 09/822,053

(22) Filed: Mar. 30, 2001

(65) Prior Publication Data

US 2002/0141196 A1 Oct. 3, 2002

(51) Int. Cl.[7] ..... F21V 33/00

(52) U.S. Cl. ..... 362/372; 362/29; 362/85; 362/368

(58) Field of Search ..... 362/362, 364, 362/365, 366, 368, 372, 85, 23, 29

(56) References Cited

U.S. PATENT DOCUMENTS 4,290,092 A * 9/1981 Bull ..... 362/61
4,583,151 A * 4/1986 Nagel ..... 362/29
5,908,236 A * 6/1999 Lueken et al. ..... 362/364
6,439,151 B1 * 8/2002 Bowers et al. ..... 116/28.1

* cited by examiner

*Primary Examiner*—Sandra O'Shea
*Assistant Examiner*—Anabel Ton
(74) *Attorney, Agent, or Firm*—Flynn, Thiel, Boutell & Tanis, P.C.

(57) ABSTRACT

A light assembly including a tray (36) that is removably fitted in a housing (12). The tray has two parallel, angled slots (48). An LED (32) is mounted to a circuit board (34) so that its axis is angularly offset from the axis of the circuit board. When the light assembly is assembled, a side edge of the circuit board is seated in one of the tray slots. If a first one circuit board side edges is seated in a first slot, the LED has a first angular orientation relative to the longitudinal axis of the housing. Alternatively, the second circuit board side edges is seated in the second slot so that the LED has a second angular orientation relative to the longitudinal axis of the housing. This allows selective control the angular orientation of the emitted light beam relative to the longitudinal axis of the housing.

34 Claims, 6 Drawing Sheets

LAMP ASSEMBLY WITH SELECTIVELY POSITIONABLE BULB

FIELD OF THE INVENTION

This invention relates generally to a light assembly such as a light assembly that can be fabricated with an LED. More particularly, this invention is directed to a light assembly in which the beam of light emitted by the light emitting element integral with the assembly is selectively set.

BACKGROUND OF THE INVENTION

Light assemblies are installed in locations in order to illuminate their surroundings. A typical light assembly includes a housing that is open at least one end. A light emitting element, such as an incandescent bulb, a halogen bulb or an LED is fitted in the housing and is directed towards the open end. A lens is sometimes fitted over the open end. The lens serves several purposes. The lens may serve to direct the light emitted by the device into a select beam pattern. The lens also functions as a barrier that prevents stray items and curious fingers from reaching into the housing and contacting the light emitting element. Thus, the lens prevents outside objects from potentially breaking the light. Also, in the case of light emitting elements such as incandescent and halogen bulbs that generate heat, it prevents the heat generated by these bulbs from potentially burning other objects. Sometimes, a reflector is mounted inside a housing behind the light emitting element. The reflector redirects the light emitted rearwardly by the light emitting element so it travels outside the open end of the housing, and through lens so as to contribute to the illumination offered by the light assembly.

The light emitted by many light emitting elements travels in a directed beam toward the adjacent surface against which the light assembly is directed. This is especially the case with conventional incandescent bulbs, halogen bulbs and LEDs. Often it is desirable to position the light emitting element in its complementary housing in a specific orientation. Consequently, when the light assembly is mounted to a complementary fixture, the light beam it emits is directed along a specific path of travel. For example, when a light assembly is used as a ceiling mounted overhead light to illuminate and underlying table surface, it is often preferable to position the light emitting element so that it emits a light beam that travels along a path generally in line with the axis of the housing. Some applications require light assemblies that are constructed so that their light emitting elements emit light in beams that travel at an angle to their complementary housing. For example, light assemblies are often mounted to the wall of a stairway to illuminate the underlying stairs. This type of light assembly installed in this location has a downwardly directed beam. Thus, the light assembly is mounted above stair level yet produces a light beam that illuminates, the underlying stair.

In order to serve their customers, many manufacturers of light assemblies like to offer different versions of the same light assembly that differ only in the direction of the light beams emitted by the assemblies. To offer this selection, the manufacturer may have to offer different versions of a basic assembly that vary only in the difference in how their light emitting elements are mounted relative to their housings. This requires the manufacture to maintain an inventory of and manufacture multiple versions of light assemblies that have only minor differences in construction.

SUMMARY OF THE INVENTION

This invention is related generally to a light assembly designed so that its light emitting element can be selectively oriented relative the housing of the assembly. This final orientation of the light emitting element is set by the end user/installer of the assembly.

An advantage of the light assembly of this invention to the manufacturer is that it eliminates the need to assemble and maintain an inventory of light assemblies that differ only in the orientation of their light emitting elements. An advantage of this invention to the end user/installer of the assembly is that he/she is provided with a single light assembly that can be used to generate a light beam that either travels in a path that is either aligned with angularly offset from the axis of the assembly. This does more than minimize the complexity of the ordering process. This feature of the invention means the end user/installer can decide at the time the light assembly is mounted to its complementary fixture the orientation of the beam emitted by the assembly. Moreover, the installer, like the manufacturer, is able to stock a single type of light assembly that can be configured in one of two ways.

BRIEF DESCRIPTION OF THE DRAWINGS

This invention is pointed out with particularity in the accompanying claims. The above and further features and benefits of this invention are better understood by reference to the following detailed description and by reference to the following drawings in which:

DETAILED DESCRIPTION

Figure 1:
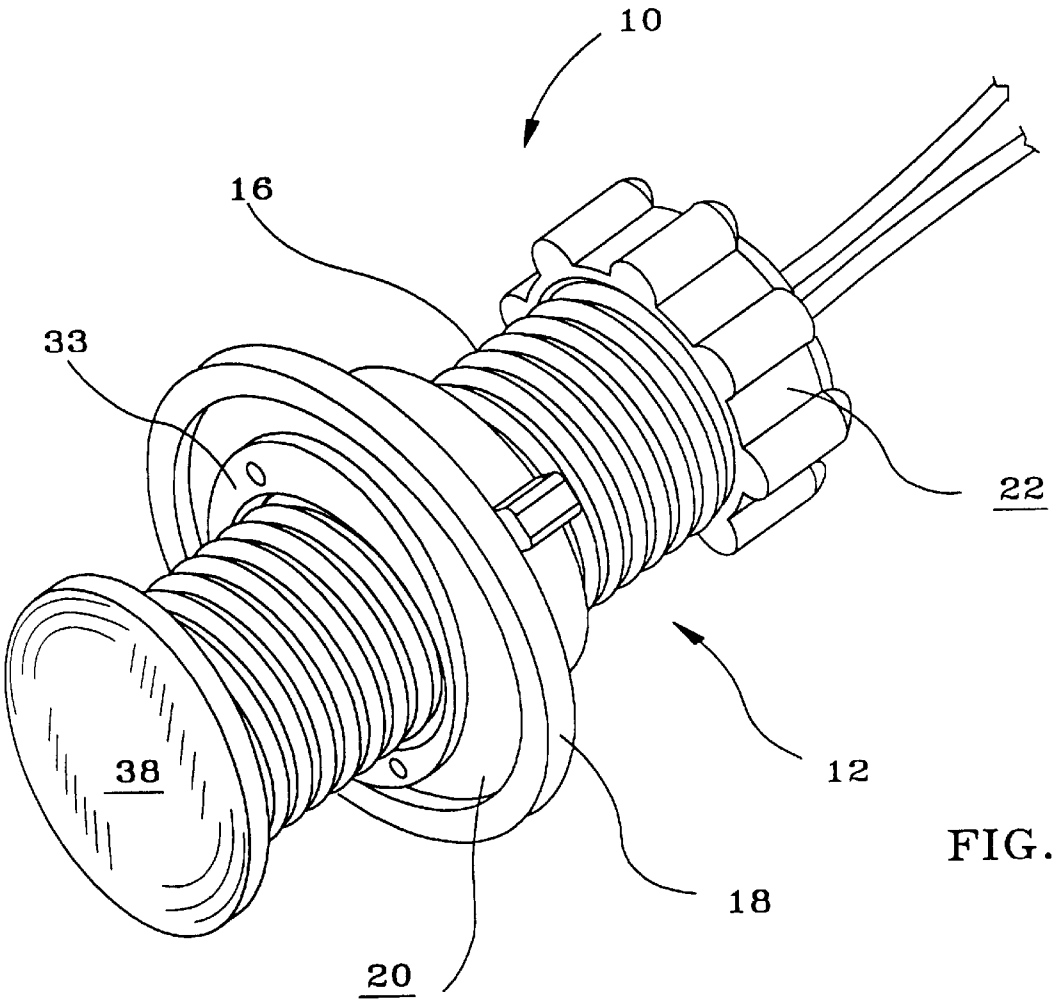
FIG. 1 is a perspective view of an assembled light assembly of this invention.
Figure 2:
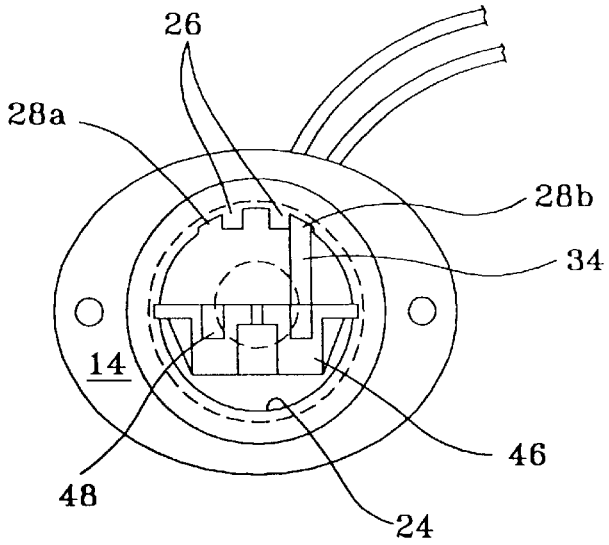
FIG. 2 is a front view of the light assembly of this invention in which the housing and the components internal to the housing are depicted.
Figure 3:
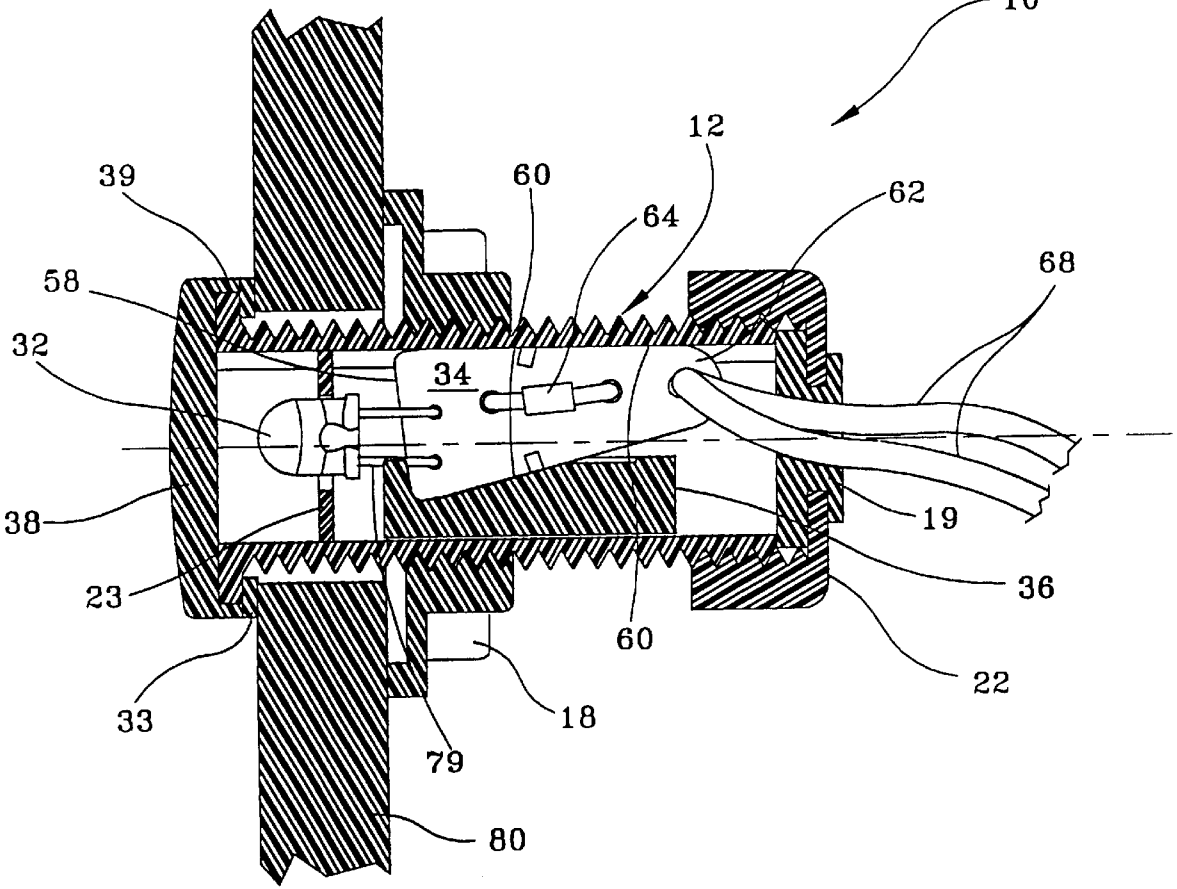
FIG. 3 is a cross sectional depicting how in one particular assembly the light assembly of this invention is mounted to a fixture.

FIGS. 1, 2 and 3 illustrate the basic components of a light assembly 10 of this invention. The assembly 10 includes a tube like housing 12 that is open at both ends. A flat face plate 14 is integrally mounted with and extends around the open front end of the housing 12. The outer surface of housing 12 is provided with threading 16 that extends rearwardly from the face plate 14. A seating nut 18 is threadedly engaged with and extends over the outer surface of the housing 12. Seating nut 18 is formed to have a relatively wide ring section 20 that extends beyond the body of the nut. Once the housing 12 is seated in the fixture to which the assembly 10 is mounted, the seating nut 18 is positioned so that its ring section 20 pressed against a concealed surface of the fixture. An end cap 22 is threadably secured to the open rear end of the housing 12.

A single piece rubber seal and grommet 19 is fitted in an opening in end cap 22 (opening not identified). Wires 68 that provide an energization current to the light emitting device of the assembly 10 extend through seal and grommet 19. When end cap 22 is screw secured to housing 12, the disk like portion of seal and grommet 19 is compressed between the end of the housing and the end cap. Thus, the seal and grommet 19 forms a water tight barrier between the housing 19 and the end cap 22.

Housing 12 is formed to have an inside wall 24 that is generally circular in cross sectional profile. The housing is formed so as to have two parallel spaced apart ribs 26 that extend downwardly from the top of wall 24 into the interior space of the housing defined by the wall. (In this description the references to a center of gravity, "top" and "bottom" are understood to mean references to a reference point located below the light assembly depicted in FIG. 2.) Ribs 26 extend longitudinally along the length of the housing 12. The housing is further formed to define two parallel grooves 28*a* and 28*b* in the inner wall 24. Each groove 28*a* and 28*b* is located adjacent the outer surface of a separate one of the ribs 26. In some versions of the invention, the outer diameter of housing 12 is 2.5 inches or less, in still more preferred versions of the invention, this outer diameter is 1 inch or less.

Housing 12 is further formed to have a circular, wall like barrier 23 that is located inside the housing and located rearward of the face plate 14. The barrier 23 is formed with an elongated slot 25 that is centered on the longitudinal axis of housing 12. When the components forming the light assembly 10 are fitted together, the light emitting element extends through slot 25. The barrier 23 thus serves to conceal the remaining components of the assembly 10 to which the light emitting element is mounted. The outer surface of barrier 23 and the surrounding portion of housing inner wall 24 are covered with a reflective coating so that these surfaces function as reflector, (coating not depicted.) The coating may also be applied to the outer surface of face plate 14 for aesthetic reasons.

The assembly 10 includes an LED 32 disposed inside the housing 12 that functions as the light emitting element of the assembly. The LED 32 is mounted to a circuit board 34. The circuit board 34 is seated in a tray 36 that is removable fitted in the bottom of the housing 12. Light assembly 10 also includes a transparent lens 38 this is formed from acrylic plastic. In order to facilitate the stable fitting of the lens 38 to the housing, the lens is formed with two opposed posts, (not illustrated,) that are located inwardly over from the perimeter of the lens. When the lens 30 is mounted to the face plate 14, the posts seat in complementary holes 42 formed in the face plate. The posts are heat stake welded to the face plate 14.

It will further be observed that a rubber seal 33 is around the housing 12 immediately rearward of the face plate 14. Lens 38 is formed to have a rim 39 that extends around the face plate 14 when the lens is fitted to the housing. As a result of the light assembly 10 to a wall 80 (FIG. 6), the lens rim is directed towards the wall. Seal 33 is dimensioned so that the perimeter of the seal is compressed between the lens rim 39. The seal 33 thus forms a barrier to prevent water from reaching the internal components of the light assembly 10.

Figure 4A:
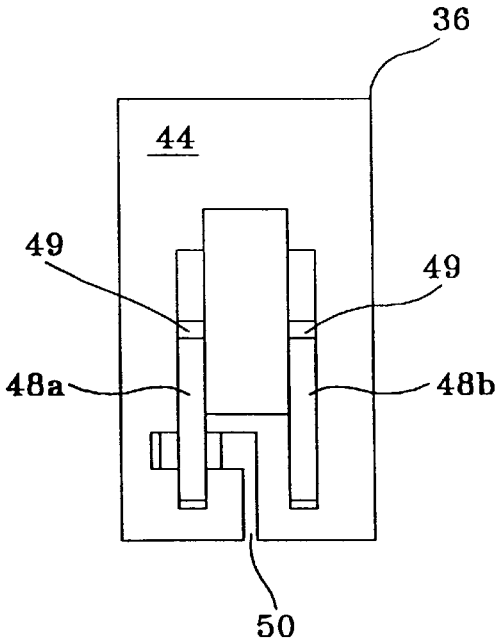
FIG. 4A is top view of the tray of the light assembly.
Figure 4B:
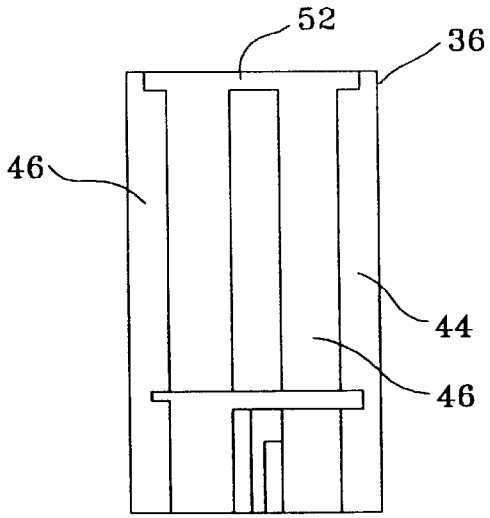
FIG. 4B is a bottom view of the tray.
Figure 4C:
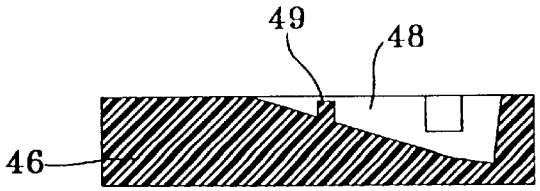
FIG. 4C is a cross sectional view of the tray taken through line 4C—4C of FIG. 4A.

As seen best by FIGS. 2, 3, 4A and 4B, the tray 36 is formed to have a generally flat planar base 44. Tray 36 is further formed so that integral with the base 44 the tray has parallel webs 46. Each web 46 has a generally rectangular cross sectional profile and extends the length of the tray. The webs are spaced apart from each other and are diametrically positioned around the longitudinal axis of the tray 36. Each web 46 is formed to have a slot 48*a* or 48*b*. Slots 48 have a triangular cross-sectional profile as seen from FIG. 4C. More specifically, each slot 48*a* and 48*b* starts, has its shallowest portion adjacent the middle of the associated web 46 in which the slot is formed. Extended along the length of the web 46, towards the front of the web, the depth of the slot 48 increases. As discussed below, the LED 32 is mounted to the circuit board 34 so as to be angularly offset from the longitudinal axis of the circuit board. The tray webs 46 are formed so that the inclined angle of both slots 48 is equal to the offset angle between the longitudinal axis of the LED 32 and the longitudinal axis of the printed circuit board 34. Tray 36 is further formed so that a small tab 49 bisects each slot 48*a* and 48*b*.

Tray 36 is further formed to have a single L-shaped slot 50 that extends from slot 48*a*, through the associated web 46 and forward through tray base 44. Locating immediately rearwardly of L-shaped slot 50, the tray is observed to have a single reinforcing flange 52 that extends between webs 46.

The LED 32 and the circuit board 34 to which the LED is mounted are now described by reference to FIGS. 3, 4, 5*a* and 5B. The circuit board 34 has a straight front edge 56. Two opposed short side edges 58 extend perpendicularly away from the front edge 56. Two opposed long side edges 60 extend rearwardly away from short side edges 58. The long side edges 60 taper inwardly toward each other. In most versions of this invention, this taper, relative to a line extending from the adjacent short side edge 58, is between 0 and 45°. In more preferred versions of the invention, this taper is between 5 and 30°. A slot 61 is formed in each side edge 62. The long side edges 60 terminate at a rear edge 62 of the circuit board. A load resistor 64 is mounted to the circuit board. Two wires 68 that provide the current for energizing the LED 32 are also bonded to and extend rearwardly away from the circuit board 34.

The LED 32 is mounted to the front of the circuit board 34 so that its longitudinal axis is angularly offset from the longitudinal axis of the circuit board. In some versions of the invention, this degree of offset is between 5 and 10° and more particularly, 7.5°. It should further be understood that, in some preferred versions of the invention angular offset of the longitudinal axis of the LED relative to the longitudinal axis of the circuit board 34 is equal to the combined angle of the angle of the tray slots 48*a* and 48*b* and the angle of the taper of the circuit board long side edges 60. In the depicted version of the invention, the LED 32 is mounted to the circuit board so that, physically, the LED is located on one side of the circuit board 34. Specifically one the leads 70 of the LED is bonded to the circuit board at a point close to the longitudinal axis of the circuit board. The second lead 72 is bonded to the circuit board 34 at a point offset from the longitudinal axis. The leads 70 and 72 are bent so that the LED 32 is located forward of the circuit board front edge 56.

It is also observed that, in the illustrated version of the invention, the LED 32 is positioned be located adjacent one side of the circuit board 34. However, as discussed below, that need not always be the case.

Figure 5A:
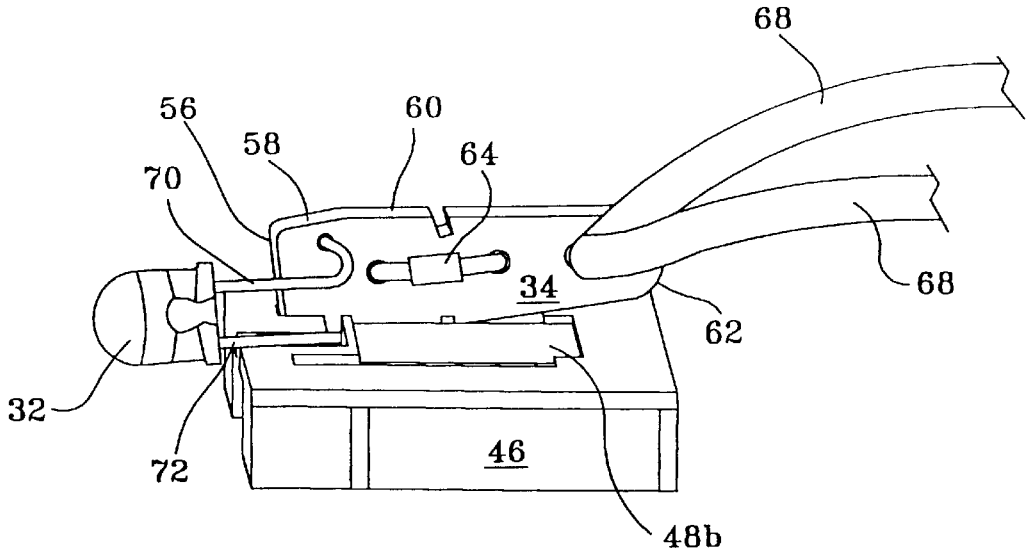
FIG. 5A is a side view depicting how the circuit board is seating in the tray in order to assembly a light assembly that emits a beam of light that extends axially from the assembly.

The arrangement of the components of this invention to form the fabricated light assembly is understood by reference to FIGS. 2, 3 and 5A. There may be times when it is desirable that the completed assembly 10 produce a beam of light that is centered on an axis that is coaxial with the longitudinal axis of the housing 12. In these assemblies of the invention, the circuit board 34 is mounted in the slot 48*a* of tray 36 as seen in FIG. 5A. When the circuit board 34 is so mounted, the angular offset of the LED from the horizontal is canceled by the angular incline of the slot 48. Consequently, the LED 32 is at least parallel to the longitudinal axis of the housing 12.

It will also be observed that tray tab 49 is seated in circuit board slot 61. As a result of this mating, the circuit board 34 remains seated in tray 36 until it is removed.

Figure 6:
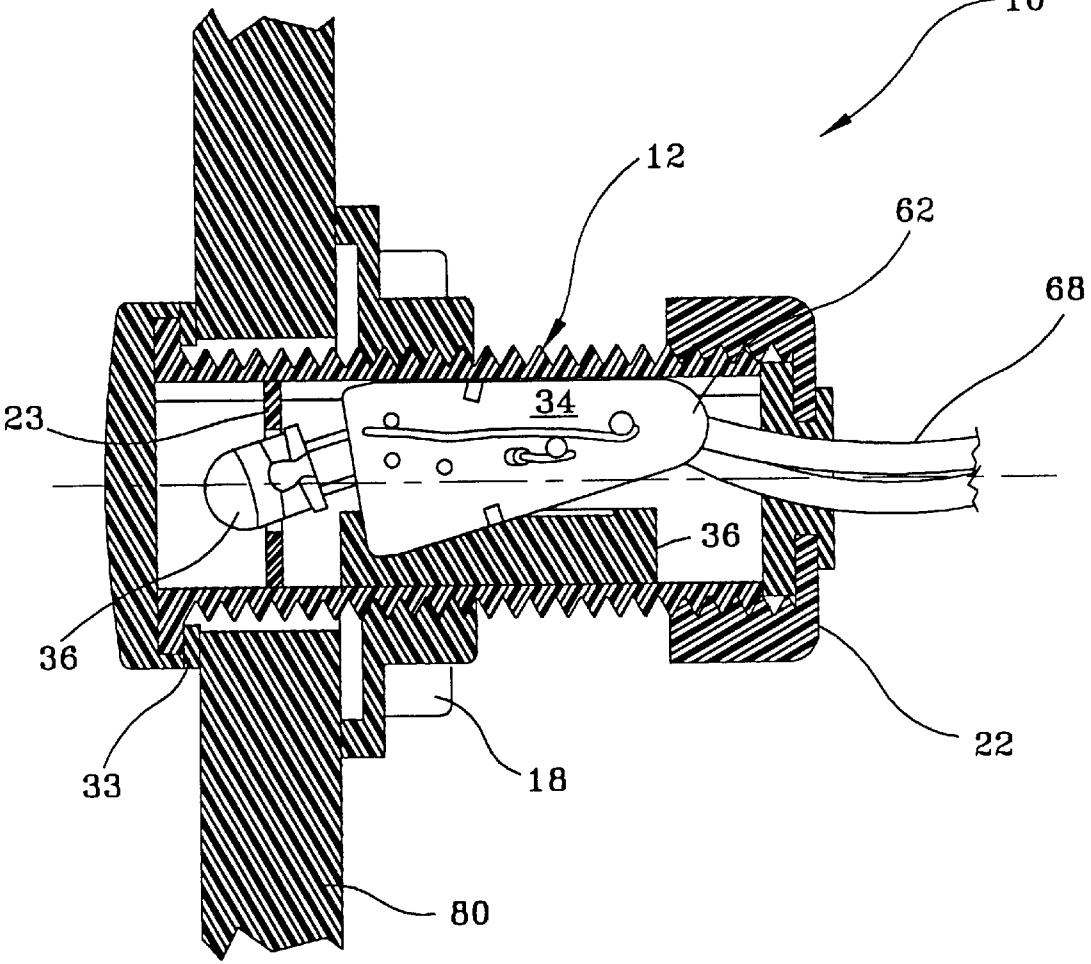
FIG. 6 is a cross sectional view that depicts how in a second particular assembly of the light assembly the light assembly of this invention is mounted to a fixture.

The LED, circuit board and tray sub-assembly is then slid into the housing 12. The circuit board side edges 58 and 60 distal from the LED 32 seat in groove 28*a* of the housing so as to stabilize the circuit board 34 in the housing. As seen in FIG. 6, the assembly 10 is fitted into the fixture, typically a wall 80, to which it is mounted. The seating nut 18 is fitted over the portion of the housing 12 that extend out beyond the concealed surface of the wall 80. Nut 18 is tightened against the wall to hold the assembly 10 in position. The end cap 22 is threaded to the rear end of the housing 12 to complete the installation of the light assembly 10.

Then, when the assembly 10 is actuated, the LED 32 emits light in a beam that is at least parallel with the longitudinal axis of the assembly housing 12. In more preferred versions of the invention, owing to the positioning of the LED 32 along the longitudinal axis of the housing 32, the axis of the LED is coaxial with the longitudinal axis of the housing. In these versions of the invention, the beam of light emitted by the LED 32 is centered along the longitudinal axis of the housing 12.

Figure 5B:
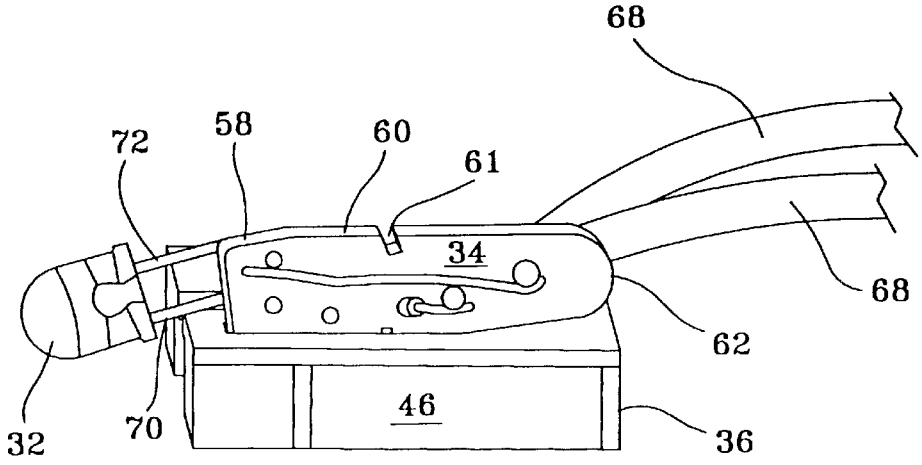
FIG. 5B is a side view depicting how the circuit board is seating in the tray in order to assembly a light assembly that emits a beam of light that extends angularly away from the longitudinal axis of the assembly.

Alternatively, it may be desirable to configure the light assembly 10 of this invention so that the beam of light emitted by the LED 32 is centered on an axis that is angularly offset from the longitudinal axis of the housing 12. When this type of configuration is desired, the circuit board 34 is rotated from its position shown in FIG. 5A and seated in slot 48*b* as seen in FIG. 5B. When the circuit board 34 is so seated, angular inclination of the circuit board caused by its seating in the slot 48*b* adds to the angular offset of the LED 32. Thus, if the offset angle of the LED 32 from the circuit board longitudinal axis and the combined incline angle of the slot 48*b* and taper of the circuit board side edges 60 are both 7.5°, the LED is oriented on an axis that is 15° downwardly offset from the horizontal. The LED, circuit board and tray sub-assembly is then slid into the housing 12 as previously described. In this construction of the invention, the circuit board side edges 58 and 60 proximal to the LED 32 seat in groove 28*b* of the housing 12. The fabrication of the light assembly 10 is completed as has been previously described.

When the above-described construction of the invention is mounted to the wall or other fixture, the light emitted by the LED is centered on an axis that is angularly offset from the longitudinal axis of the assembly housing 12 as seen in FIG. 6.

Thus, the light assembly 10 essentially provides two different versions of the same assembly. Depending upon how the components of this assembly are configured, in a first version, the assembly emits a beam of light around an axis that is essentially coaxial with the assembly housing 12. In a second configuration of the components, the assembly 10 is constructed so that the LED 32 emits light in a beam that is angularly offset from the horizontal axis of the assembly housing 12.

In the light assembly of this invention, slots 48*a* and 48*b* are located symmetrically around the longitudinal axis of the housing 12. Thus, regardless of which slot the circuit board 34 is seated in, the LED will be in line with the housing axis. Consequently, the light emitted from the assembly 10 of this invention is always emitted from the center of the housing regardless of the degree of angular offset of the beam from the centerline. Thus, a change in the position of the circuit board 34 in the housing 12 does not result in the aesthetically disconcerting emission of light from an off-center location in the housing.

One advantage of the light assembly 10 of this invention is that it eliminates the need for the manufacturer to have in stock two versions of the same light assembly that vary only in the direction of the light emitted by the associated beam. This serves to reduce the help the manufacturer minimizes its total number of stock keeping units. This also means that the manufacturer does not have to engage in different product runs in order to produce the two different versions of same light assembly.

The light assembly of this invention also has advantages to the end user/installer. One of these benefits is that the end user/installer does not have to specify the specific version of this light assembly it wants when ordering the assembly. This eliminates the potential that end user can potentially order the wrong version of the assembly. Also, the end user does not have to configure the assembly until it is installed. Thus, the end user/installer can, upon installing the assembly determine which beam orientation is best for a specific application of the assembly by resetting the position of the circuit board 34 in the housing 32. Once the orientation is determined, the light assembly can be properly arranged and assembled in place. The lens 38 prevents curious fingers from tampering with the final setting of the assembly 10.

Still another advantage of the assembly 10 of this invention is that the circuit board is seated in the tray and the tray is seated in the housing without the use of supplemental fasteners. This makes it very simply to easily configure and, if necessary, reconfigure the assembly of this invention.

Figure 7:
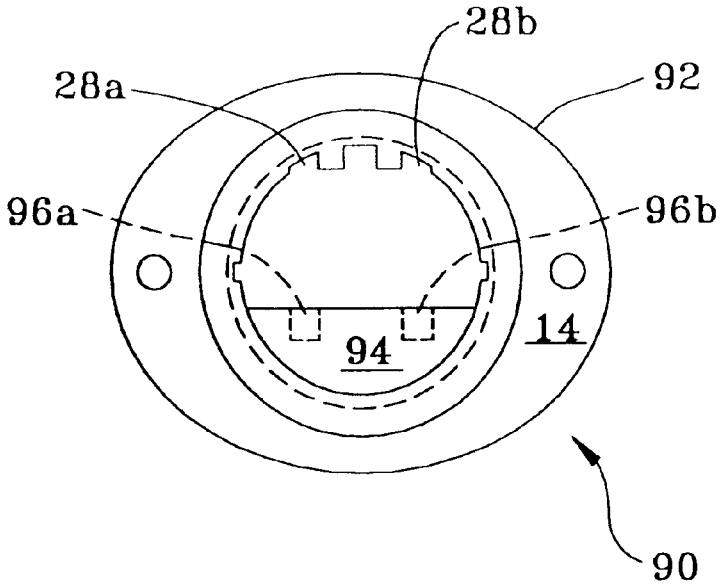
FIG. 7 is a view of the lower interior surface of an alternative housing of an alternative light assembly of this invention.

FIG. 7 illustrates an alternative assembly 90 of this invention. Assembly 90 includes a housing 92. Housing 92 is generally similar to housing 12. However, the inside of housing 92 has a lower semi-circular section 94 that is generally solid. Section 94 is further formed so as to have two slots 96*a* and 96*b*. Slot 96*a* is coplanar with groove 28*a*; slot 96*b* is similarly aligned with slot 96*b*. Slots 96*a* and 96*b* perform the same function as tray slots 48*a* and 48*b*. An advantage of assembly 90 is that it eliminates the need to provide the separate tray 36. The remaining components of assembly 90 are identical to those of the first-described version of this invention.

It should be recognized that the foregoing disclosure merely describes two versions of the light assembly of this invention. Other versions of the light assembly may have features different from what been described. For example, it should be recognizes that in other versions of the invention may employ light emitting elements different from what have been described. In other versions of the invention, it may be necessary or appropriate to mount a reflector to the circuit board behind the light emitting element to redirect light emitted rearwardly by the element out of the front end of the housing. Furthermore devices other than the disclosed circuit board may be employed to hold the light emitting element in the housing. For example, with some light emitting elements a small symmetrically formed piece of plastic may serve as the mounting member to which the light emitting element is secured.

It should further be recognized that, in some versions of the invention the housing in which the light emitting element is seated may have a single slot. In these versions of the invention, one side of the circuit board is seated in the slot when the light is to be emitted at a first angle relative to the longitudinal centerline of the housing. The opposed side of the circuit board is seated in the slot when the light is to be emitted at the second relative to the longitudinal axis of the housing. In these versions of the invention, it may be desirable to mount the light emitting element to the circuit board so that its longitudinal axis is coplanar with the circuit board. This construction will ensure that, when the light and circuit board sub-assembly are mounted in the housing, the longitudinal axis of the circuit board will intersect and/or be coaxial with the longitudinal axis of the housing. Then, regardless of the angular orientation of the light emitting element, the device will emit light from the center of the housing.

Also, in some versions of the invention, either the side edges of the mounting member to which the light emitting device is attached or the slot it is seated may be formed to be essentially parallel with the longitudinal axis of the housing 12. In these versions of the invention, the other one of these components, the slot-defining structural member or the mounting member, may be formed with the taper needed to facilitate the proper final orientation of the light emitting device. For example in these versions of the invention, the angle of the slot relative to the longitudinal axis of the housing may be the same angle as the offset angle between the axis of the light emitting element relative to the longitudinal axis of the member to which the element is mounted. In alternative versions of the invention, the angle of the side surfaces of the mounting member relative to the longitudinal axis of the mounting member may be the same angle as the offset angle between the axis of the light emitting element relative to the longitudinal axis of the mounting member.

Moreover, in some versions of the invention, the tray or other slot-defining member may have three or more slots. These supplemental slots may be shaped to have an angle that is greater than the angle of the described slots. This would allow the circuit board 34 to be set in the assembly housing 12 at an angle greater than possible in the two-slot version of this invention. A benefit of this version of the invention is that it provides a single light assembly that can be selectively configures so that emits light along one of three or more beam angles.

In still other versions of the invention wherein the tray 36 or housing 92 have two slots, the slots may have different angles. In these versions of the invention, the LED 32 may be mounted to the circuit board so that it is symmetrically positioned around the longitudinal axis of the circuit board. In these versions of the invention, the grooves 28 formed in the assembly 28 may be of different depths.

Likewise, it should be understood that the description of the emitted light beam as being angularly offset from the horizontal is only exemplary and not limiting. Depending on the orientation of the assembly of this invention to the complementary fixture to which the assembly is attached, the light emitted by it may divert away an angle that is sidewise, upwardly or diagonally away from the longitudinal axis of the housing.

Therefore, it is the object of the appended claims to cover all such variations and modifications as come within the true spirit and scope of the invention.

What is claimed is:

1. A light assembly, said light assembly including:

a housing having a longitudinal axis and a receiving space that opens into an open front end of said housing;

a mounting member disposed in the receiving space of said housing, said mounting member having a longitudinal axis and side edges on opposed sides of the longitudinal axis;

a light emitting element mounted to said mounting member, said light emitting element having a longitudinal axis and being secured to said mounting member so that the longitudinal axis of said light emitting element is angularly offset from the longitudinal axis of said mounting member; and a seating member disposed in said housing, said seating member having at least one slot in which either side of said mounting member is removably seated, said member being formed so that the slot has a base that is inclined at an angle relative to the longitudinal axis of said housing so that: when a first one of the sides of said mounting member is seated in the slot, the light emitting element is directed toward the front end of said housing and the longitudinal axis of said light emitting element is at a first angle relative to the longitudinal axis of said housing; and, when a second of the sides of said mounting member is seated in the slot, the light emitting element is directed toward the front end of said housing and the longitudinal axis of said light emitting element is at a second angle relative to the longitudinal axis of said housing.

2. The light assembly of claim 1, wherein said mounting member is formed to have a front edge that is perpendicular to the longitudinal axis of said mounting member and the opposed side edges and said mounting member is formed so that the side edges are angled relative to the longitudinal axis of said mounting member.

3. The light assembly of claim 2, wherein said mounting member and said seating member are formed so that the combined angle of one of the side edges of said mounting member side edges relative to the longitudinal axis of said mounting member and the angular incline of the slot base of said seating member relative to the longitudinal axis of said housing is equal to the angle the longitudinal axis of said light emitting element is offset from the longitudinal axis of said mounting member.

4. The light assembly of claim 1, wherein:

said light emitting element is mounted to said mounting member so as to be laterally spaced away from said mounting member;

said seating member is formed with two parallel slots, said slots being located on opposed sides of the longitudinal axis of said housing and equidistantly spaced from the longitudinal axis of said housing and said slots are inclined a common angle from the longitudinal axis of said housing; and said mounting member is selectively seatable in either of the slots such that:

when the first side edge of the mounting member is seated in a first one of the slots, the light emitting element is adjacent the longitudinal axis of said housing and is oriented at the first angle relative to said housing; and when the second side edge of the mounting member is seated in a second one of the slots, the light emitting element is adjacent the longitudinal axis of said housing and is oriented at the second angle relative to said housing.

5. The light assembly of claim 4, further including a tray that is removable fitted in the receiving said space and said tray is said seating member in which said slots are formed.

6. The light assembly of claim 4, wherein: said housing is further formed with at least two grooves, each groove being aligned with and spaced apart from a separate one of the slots; and said mounting member is dimensioned so that when one of the side edges of said mounting member is seated in one of the slots, the opposite side edge is seated in the groove aligned with the slot.

7. The light assembly of claim 1, further including a tray that is removable fitted in the receiving said space and said tray is said seating member in which said slot is formed.

8. The light assembly of claim 1, wherein: said housing is further formed with a groove that is aligned with and spaced from the slot; and said mounting member is dimensioned so that when one of the side edges of said mounting member is seated in the slot, the opposite side edge is seated in the groove.

9. The light assembly of claim 1, wherein said light emitting element is an LED.

10. The light assembly of claim 1, wherein said mounting member is a circuit board to which said light emitting element is mounted.

11. The light assembly of claim 1, wherein said housing has a maximum outer diameter of 2.5 inches.

12. The light assembly of claim 1, wherein said housing has a maximum outer diameter of 2.5 inches.

13. A light assembly, said light assembly including:

a housing, said housing having: a longitudinal axis; a receiving space that is substantially parallel to the longitudinal axis, the receiving space extending to an open front end said housing; and two elongated slots that are contiguous with the receiving space, said slots being located on opposed sides of the longitudinal axis and being equidistantly spaced from the longitudinal axis, said slots having bases that are inclined downwardly toward the front end of said housing a common angle from the longitudinal axis;

a mounting member having a longitudinal axis, said mounting member being disposed in the receiving space and positioned in one of the slots, said mounting member having a opposed side edges such that: when said mounting member is positioned in a first one of the slots, a first one of the side edges is seated in the first slot; and, when said mounting member is positioned in a second one of the slots, a second one of the edges is seated in the second slot; and a light emitting element fixedly secured to said mounting member, said light emitting element being secured to said mounting member so as to emit a beam of light toward the front end of said housing and said light emitting is secured to said mounting member so that said light emitting member is centered along an axis that is angularly offset from the longitudinal axis of said mounting member.

14. The light assembly of claim 13, wherein said slots are shaped to have bases that are inclined relative to the longitudinal axis of said housing by the same angle the longitudinal axis of said light emitting element is offset from the longitudinal axis of said mounting member so that: when said mounting member is positioned in the first slot, the light emitting element is oriented so that the axis of the emitted light beam is parallel or coaxial to the longitudinal axis of said housing; and, when said mounting member is positioned in the second slot, the light emitting element is oriented so that the axis of the emitted light beam is angularly offset from the longitudinal axis of said housing.

15. The light assembly of claim 13, further including a tray that is removable fitted in the receiving said space and said tray is formed so as to define the slots in which said mounting member is selectively positioned.

16. The light assembly of claim 13, wherein: said housing is further formed with at least two grooves, each groove being aligned with and spaced apart from a separate one of the slots; and said mounting member is dimensioned so that when one of the side edges of said mounting member is seated in one of the slots, the opposite side edge is seated in the groove aligned with the slot.

17. The light assembly of claim 13, wherein said light emitting element is an LED.

18. The light assembly of claim 13, wherein said housing has a maximum outer diameter of 2.5 inches.

19. The light assembly of claim 13, wherein said mounting member is a circuit board to which said light emitting element is mounted.

20. The light assembly of claim 13, wherein said mounting member is formed to have a front edge that is perpendicular to the longitudinal axis of said mounting member and opposed side edges and said mounting member is formed so that the sides are angled relative to the longitudinal axis of said mounting member.

21. A light assembly, said light assembly including:

a housing, said housing having an open front end, a receiving space that extends rearwardly from the front end and at least one groove that is contiguous with said receiving space;

a mounting member disposed in the receiving space of said housing, said mounting member having a longitudinal axis, side edges located on opposed sides of the longitudinal axis and said mounting member is disposed in said housing so that one of the side edges is selectively fitted in the groove of said housing;

a light emitting element secured to said mounting member so as to emit a beam of light towards the front end of said housing, said light emitting assembly being secured to said mounting member so that emitted beam of light is centered on an axis that angularly offset from the longitudinal axis of said mounting member; and a tray removably fitted in the receiving space of said housing, said tray being spaced opposite the groove relative to the longitudinal axis of said housing, said tray defining a slot that is aligned with the groove, the slot being shaped to have an incline toward the front end of said housing and said tray and said mounting member are selectively dimensioned so that when one side edge of said mounting member is fitted in the housing groove, the opposed side edge is seated in the slot wherein the angular position of said beam of light emitted by said light emitting assembly relative to the longitudinal axis of said housing is a function of which one of said side edges of mounting member is seated in the tray slot.

22. The light assembly of claim 21, wherein said mounting member is formed to have a front edge that is perpendicular to the longitudinal axis of said mounting member and opposed side edges and said mounting member is formed so that the sides are angled relative to the longitudinal axis of said mounting member.

23. The light assembly of claim 22, wherein said mounting member and said tray are formed so that the combined angle of one of the side edges of said mounting member side edges relative to the longitudinal axis of said mounting member and the angular incline of the slot of said tray relative to the longitudinal axis of said housing is equal to the angle the longitudinal axis of said light emitting element is offset from the longitudinal axis of said mounting member.

24. The light assembly of claim 21, wherein:

said light emitting element is mounted to said mounting member so that the emitted beam of light is centered on an axis that is laterally spaced away from said mounting member;

said tray is formed with two parallel slots, said slots being located on opposed sides of the longitudinal axis of said housing and equidistantly spaced from the longitudinal axis of said housing and said slots are inclined a common angle from the longitudinal axis of said housing; and said mounting member is selectively seatable in either of the slots such that:

when the first side edge of the mounting member is seated in a first one of the slots, the emitted beam of light is centered on an axis that is adjacent the longitudinal axis of said housing and is oriented at a first angle relative to said housing; and when the second side edge of the mounting member is seated in a second one of the slots, the emitted beam of light is centered on an axis that is adjacent the longitudinal axis of said housing and is oriented at a second angle relative to said housing.

25. The light assembly of claim 24, wherein said tray is formed so that the slot bases are inclined relative to the longitudinal axis of said housing by the same angle the longitudinal axis of said light emitting element is offset from the longitudinal axis of said mounting member.

26. The light assembly of claim 24, wherein: said housing is further formed with two grooves, each said groove being aligned with a separate one of the slots of said tray; slot; and said mounting member is dimensioned so that when one of the sides of said mounting member is seated in one of the slots of said tray opposite side is seated in the groove.

27. The light assembly of claim 21, wherein said light emitting element is an LED.

28. The light assembly of claim 21, wherein said housing has a maximum outer diameter of 2.5 inches.

29. The light assembly of claim 21, wherein said mounting member is a circuit board to which said light emitting element is secured.

30. A light assembly, said light assembly including:

a housing having a longitudinal axis and a receiving space that opens into an open front end of said housing;

a mounting member disposed in the receiving space of said housing, said mounting member having a longitudinal axis and side edges on opposed sides of the longitudinal axis, wherein said mounting member is formed so that the sides are angled relative to the longitudinal axis of said mounting member;

a light emitting element mounted to said mounting member, said light emitting element having a longitudinal axis and being secured to said mounting member so that the longitudinal axis of said light emitting element is angularly offset from the longitudinal axis of said mounting member; and a seating member disposed in said housing, said seating member having at least one slot in which either side of said mounting member is removably seated so that: when a first one of the sides of said mounting member is seated in the slot, the light emitting element is directed toward the front end of said housing and the longitudinal axis of said light emitting element is at a first angle relative to the longitudinal axis of said housing; and, when a second of the sides of said mounting member is seated in the slot, the light emitting element is directed toward the front end of said housing and the longitudinal axis of said light emitting element is at a second angle relative to the longitudinal axis of said housing.

31. The light assembly of claim 30, wherein:

said light emitting element is mounted to said mounting member so as to be laterally spaced away from said mounting member;

said seating member is formed with two parallel slots, said slots being located on opposed sides of the longitudinal axis of said housing and equidistantly spaced from the longitudinal axis of said housing and said slots are inclined a common angle from the longitudinal axis of said housing; and said mounting member is selectively seatable in either of the slots such that:

when the first side edge of the mounting member is seated in a first one of the slots, the light emitting element is adjacent the longitudinal axis of said housing and is oriented at the first angle relative to said housing; and when the second side edge of the mounting member is seated in a second one of the slots, the light emitting element is adjacent the longitudinal axis of said housing and is oriented at the second angle relative to said housing.

32. The light assembly of claim 30, further including a tray that is removable fitted in the receiving said space and said tray is said seating member in which the slot is formed.

33. The light assembly of claim 30, wherein: said housing is further formed with a groove that is aligned with and spaced from the slot; and said mounting member is dimensioned so that when one of the side edges of said mounting member is seated in the slot, the opposite side edge is seated in the groove.

34. The light assembly of claim 30, wherein said light emitting element is an LED.

* * * * *